US011621496B2

(12) United States Patent
Nemoto et al.

(10) Patent No.: US 11,621,496 B2
(45) Date of Patent: Apr. 4, 2023

(54) ANTENNA DEVICE

(71) Applicant: Murata Manufacturing Co., Ltd., Kyoto (JP)

(72) Inventors: Takaya Nemoto, Kyoto (JP); Hideki Ueda, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 282 days.

(21) Appl. No.: 17/136,184

(22) Filed: Dec. 29, 2020

(65) Prior Publication Data

US 2021/0119344 A1 Apr. 22, 2021

Related U.S. Application Data

(63) Continuation of application No. PCT/JP2019/025459, filed on Jun. 26, 2019.

(30) Foreign Application Priority Data

Jul. 3, 2018 (JP) ..... JP2018-126895

(51) Int. Cl.
*H01Q 19/26* (2006.01)
*H01Q 1/48* (2006.01)
(Continued)

(52) U.S. Cl.
CPC ..... *H01Q 19/26* (2013.01); *H01Q 1/48* (2013.01); *H01Q 19/24* (2013.01); *H01Q 21/0006* (2013.01); *H01Q 21/062* (2013.01)

(58) Field of Classification Search
CPC ..... H01Q 1/48; H01Q 21/0006; H01Q 21/06; H01Q 21/24–28; H01Q 19/24–26; H01Q 19/10
See application file for complete search history.

(56) References Cited

U.S. PATENT DOCUMENTS 6,486,847 B1 11/2002 Yamamoto et al.
9,590,317 B2 * 3/2017 Zimmerman ..... H01Q 15/141
(Continued)

FOREIGN PATENT DOCUMENTS

JP 2001-308630 A 11/2001
JP 2003-347841 A 12/2003
(Continued)

OTHER PUBLICATIONS

International Search Report for PCT/JP2019/025459 dated Aug. 13, 2019.
Written Opinion for PCT/JP2019/025459 dated Aug. 13, 2019.

*Primary Examiner* — Hasan Islam
(74) *Attorney, Agent, or Firm* — Pearne & Gordon LLP

(57) ABSTRACT

An antenna device includes a substrate, a first antenna element extending in a direction perpendicular to a first surface of the substrate and functioning as a monopole antenna, a second antenna element provided adjacent to the first antenna element, extending in the direction perpendicular to the first surface of the substrate, and functioning as a monopole antenna, a ground layer provided in or on the substrate, a connection wire provided in or on the substrate and connecting the first antenna element and the second antenna element to each other, a power feeding line provided in or on the substrate and connected to the connection wire, and a first reflector provided in a direction in which the first antenna element and the second antenna element are adjacent to each other and facing the first antenna element and the second antenna element.

20 Claims, 15 Drawing Sheets

(51) Int. Cl.

| | |
|---|---|
| ***H01Q 19/24*** | (2006.01) |
| ***H01Q 21/00*** | (2006.01) |
| ***H01Q 21/06*** | (2006.01) |

(56) References Cited

U.S. PATENT DOCUMENTS

| | | | |
|---|---|---|---|
| 2009/0051619 | A1 | 2/2009 | Hook et al. |
| 2009/0085827 | A1 | 4/2009 | Orime et al. |
| 2014/0125541 | A1 | 5/2014 | Hong et al. |
| 2019/0319359 | A1 | 10/2019 | Hayata |

FOREIGN PATENT DOCUMENTS

| | | | |
|---|---|---|---|
| JP | 2009-089212 | A | 4/2009 |
| JP | 2009-521830 | A | 6/2009 |
| JP | 2010-200211 | A | 9/2010 |
| WO | 2018/079521 | A1 | 5/2018 |

* cited by examiner

ANTENNA DEVICE

CROSS REFERENCE TO RELATED APPLICATION

This is a continuation of International Application No. PCT/JP2019/025459 filed on Jun. 26, 2019 which claims priority from Japanese Patent Application No. 2018-126895 filed on Jul. 3, 2018. The contents of these applications are incorporated herein by reference in their entireties.

BACKGROUND OF THE DISCLOSURE

Field of the Disclosure

The present disclosure relates to an antenna device.

Description of the Related Art

Patent Document 1 describes a monopole antenna with a conductive reflector. The monopole antenna with the conductive reflector in Patent Document 1 includes a monopole antenna element provided in or on a substrate plate, and a conductive reflector provided in parallel with the monopole antenna element.

Patent Document 1: Japanese Unexamined Patent Application Publication No. 2003-347841

BRIEF SUMMARY OF THE DISCLOSURE

The monopole antenna with the conductive reflector in Patent Document 1 emits radio waves in a direction perpendicular to the conductive reflector and also emits radio waves in a direction parallel to the conductive reflector. Therefore, there is a possibility that a gain of signals in a direction opposite to the conductive reflector with respect to the monopole antenna element decreases.

An object of the present disclosure is to provide an antenna device capable of improving directivity in a direction perpendicular to an end surface of a substrate.

An antenna device of one aspect of the present disclosure includes: a substrate having a first surface, a second surface that faces the first surface, a first end surface and a second end surface that connect the first surface and the second surface to each other and that face each other, and a third end surface and a fourth end surface that connect the first surface and the second surface to each other and that are present between the first end surface and the second end surface; a first antenna element that extends in a direction perpendicular to the first surface of the substrate and that functions as a monopole antenna; a second antenna that is provided adjacent to the first antenna element, that extends in the direction perpendicular to the first surface of the substrate, and that functions as a monopole antenna; a ground layer provided in or on the substrate; a connection wire that is provided in or on the substrate and that connects the first antenna element and the second antenna element to each other; a power feeding line that is provided in or on the substrate and that is connected to the connection wire; and a first reflector that is provided in a direction in which the first antenna element and the second antenna element are adjacent to each other and that faces the first antenna element and the second antenna element. The first antenna element and the second antenna element are provided along at least one end surface of the first end surface to the fourth end surface, overlap the first reflector in a side view in a direction perpendicular to the at least one end surface, and are located between the at least one end surface and the first reflector in a plan view.

According to an antenna device of the present disclosure, it is possible to improve directivity in a direction perpendicular to an end surface of a substrate.

DETAILED DESCRIPTION OF THE DISCLOSURE

Hereinafter, embodiments of an antenna device of the present disclosure will be described on the basis of the drawings. The embodiments are not intended to limit the present disclosure. Each of the embodiments is presented as an example, and it is needless to say that partial replacement or combination of the configurations presented in different embodiments are possible. In the second and later embodiments, the description of the matters common to the first embodiment is omitted, and only the differences will be described. In particular, the same operational effects by the same configurations are not mentioned one by one in each embodiment.

First Embodiment

Figure 1:
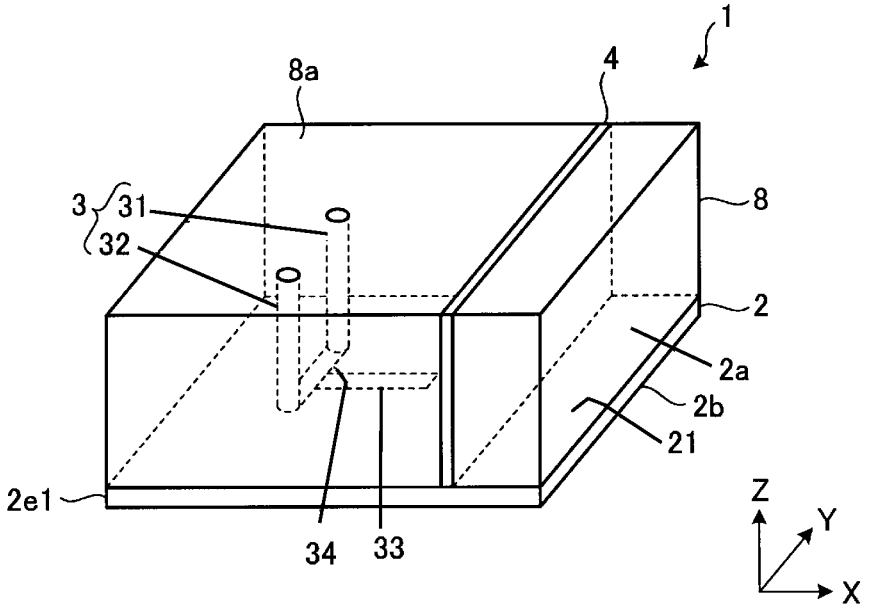
FIG. 1 is a transparent perspective view of an antenna device according to a first embodiment.
Figure 2:
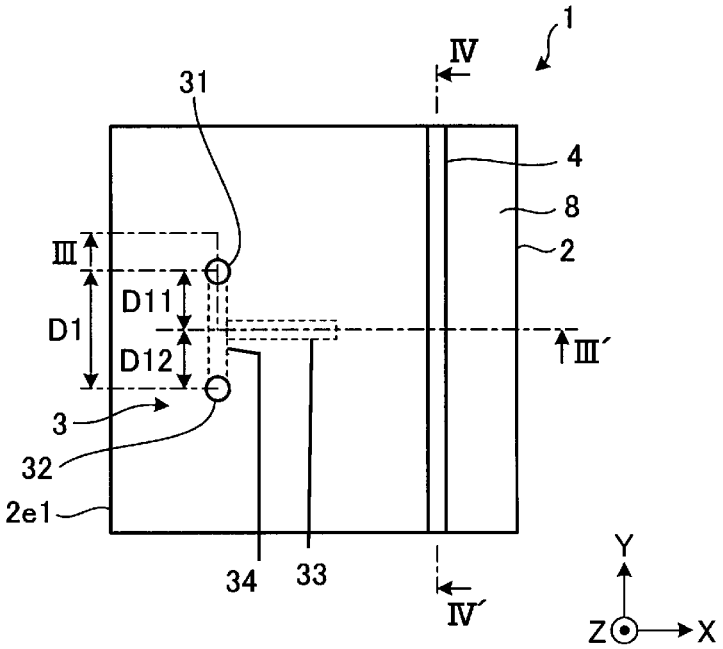
FIG. 2 is a plan view of the antenna device according to the first embodiment.
Figure 3:
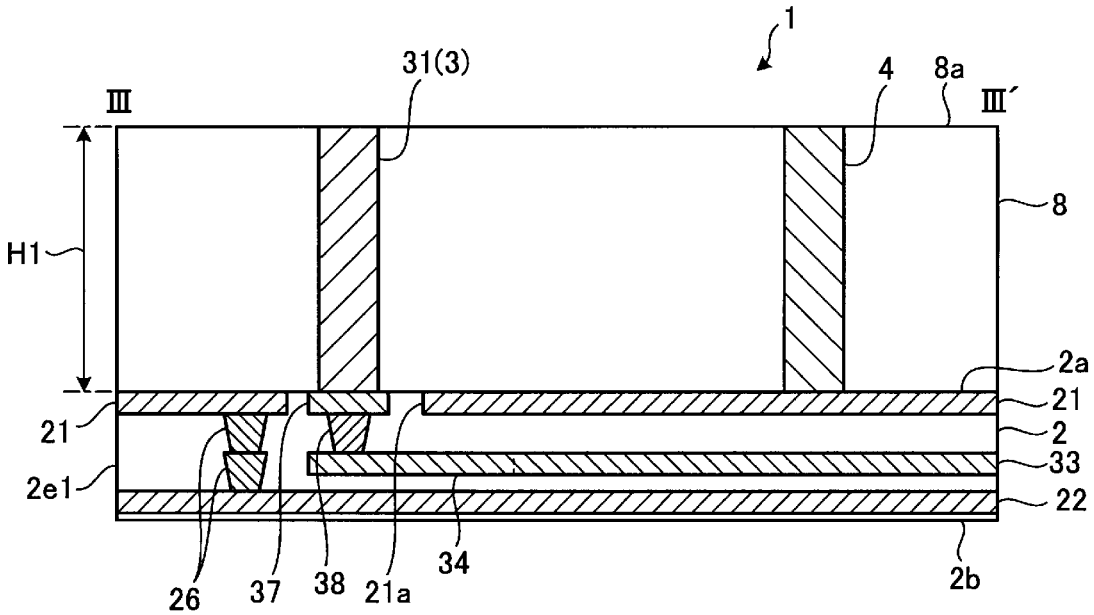
FIG. 3 is a sectional view along line III-III' of FIG. 2.

FIG. 1 is a transparent perspective view of an antenna device according to a first embodiment. FIG. 2 is a plan view of the antenna device according to the first embodiment. FIG. 3 is a sectional view along line III-III' of FIG. 2. An antenna device 1 of the present embodiment transmits and receives signals in, for example, submillimeter-wave bands and millimeter-wave bands (for example, 20 GHz or more and 300 GHz or less). The antenna device 1 is not limited thereto and may transmit and receive signals in microwave bands of 10 GHz or less.

As illustrated in FIG. 1, the antenna device 1 includes a substrate 2, a pair of monopole antennas 3, a first reflector 4, a power feeding line 33, a connection wire 34, a first ground layer 21, a second ground layer 22 (refer to FIG. 3), and a resin layer 8. The substrate 2 has a first surface 2*a* and a second surface 2*b* opposite to the first surface 2*a*. As the substrate 2, for example, a low-temperature co-fired ceramic multilayer substrate (LTCC (Low Temperature Co-fired Ceramics) multilayer substrate) is used. The substrate 2 has a plurality of insulating layers laminated in a Z direction. Each of the insulating layers is formed into a thin layer shape by using a ceramic material that can be sintered at a low temperature of 1000° C. or less. The substrate 2 is not limited thereto and may be a multilayer resin substrate formed by laminating a plurality of resin layers constituted by a resin of epoxy, polyimide, or the like. The substrate 2 may be formed by using a liquid crystal polymer (Liquid Crystal Polymer: LCP) having a lower dielectric constant, or a fluorine-based resin.

Alternatively, the substrate 2 may be a ceramic multilayer substrate. The substrate 2 may be a flexible substrate having flexibility or may be a rigid substrate having thermoplasticity.

In the following description, a direction in a plane parallel to the first surface 2*a* of the substrate 2 is referred to as an X direction. A direction orthogonal to the X direction in the plane parallel to the first surface 2*a* is referred to as a Y direction. A direction orthogonal to each of the X direction and the Y direction is referred to as a Z direction.

The pair of monopole antennas 3 includes a first antenna element 31 and a second antenna element 32. The first antenna element 31 and the second antenna element 32 are provided on the first surface 2*a* of the substrate 2, extend in a direction (the Z direction) perpendicular to the first surface 2*a*, and each function as a monopole antenna. Each of the first antenna element 31 and the second antenna element 32 is a columnar conductor and is, for example, a pin that is formed of a metal material. The first antenna element 31 and the second antenna element 32 are connected to a pad 37 (refer to FIG. 3) provided in or on the substrate 2, for example, by a conductive adhesive, such as solder.

As illustrated in FIG. 1 and FIG. 2, the second antenna element 32 is provided adjacent to the first antenna element 31 in the Y direction. In the periphery of the substrate 2, an end surface opposite to the first reflector 4 with respect to the pair of monopole antennas 3 is referred to as a first end surface 2*e*1. The first end surface 2*e*1 is provided in the Y direction. The first antenna element 31 and the second antenna element 32 are disposed side by side along the first end surface 2*e*1.

The connection wire 34 extends in the Y direction and connects the first antenna element 31 and the second antenna element 32 to each other. The power feeding line 33 extends in the X direction, and one end thereof is connected to the connection wire 34. The other end of the power feeding line 33 is electrically connected to a signal processing circuit (not illustrated), such as a RFIC (Radio Frequency Integrated Circuit) or the like. In the transmission of signals by the antenna device 1, signals from a RFIC are branched to the connection wire 34 through the power feeding line 33 and supplied to each of the first antenna element 31 and the second antenna element 32. In the reception of signals by the antenna device 1, signals received by each of the first antenna element 31 and the second antenna element 32 are supplied to the RFIC from the connection wire 34 through the common power feeding line 33.

As illustrated in FIG. 2, the power feeding line 33 is connected to the connection wire 34 at the position of a midpoint of a virtual line connecting the first antenna element 31 and the second antenna element 32. Specifically, in the Y direction parallel to the first surface 2*a* of the substrate 2, a distance D11 between a location at which the connection wire 34 and the power feeding line 33 are connected and the first antenna element 31 is equal to a distance D12 between the location at which the connection wire 34 and the power feeding line 33 are connected and the second antenna element 32.

Consequently, the phases of signals supplied via the power feeding line 33 to each of the first antenna element 31 and the second antenna element 32 are equal to each other, and it is possible to increase a gain of the signals emitted toward the first end surface 2*e*1.

The location at which the power feeding line 33 and the connection wire 34 are connected is not limited thereto. In other words, the distance D11 and the distance D12 may differ from each other in the Y direction. Consequently, it is possible to cause the phases of the signals supplied to each of the first antenna element 31 and the second antenna element 32 to differ from each other. The antenna device 1 can cause the directivity (radiating pattern) of the signals emitted from the pair of monopole antennas 3 to differ from each other, compared with when the distance D11 and the distance D12 are equal.

The first reflector 4 is a flat plate-shaped conductor parallel to the Y-Z plane and is provided on the first surface 2*a* of the substrate 2. The first reflector 4 is provided in a direction in which the first antenna element 31 and the second antenna element 32 are adjacent to each other, that is, in the Y direction and faces the first antenna element 31 and the second antenna element 32 in the X direction. The first antenna element 31 and the second antenna element 32 are disposed between the first end surface 2*e*1 and the first reflector 4.

Among signals emitted from the first antenna element 31 and the second antenna element 32, signals in the X direction (+X direction) are suppressed by the first reflector 4 from being emitted. Thus, the directivity of the signals emitted toward a side opposite to the first reflector 4 with respect to the first antenna element 31 and the second antenna element 32, that is, toward the first end surface 2*e*1 is improved.

As illustrated in FIG. 3, the first ground layer 21 and the second ground layer 22 are provided in or on the substrate 2. The first ground layer 21 is provided on the side of the first surface 2*a* of the substrate 2 and connected to the first reflector 4. The second ground layer 22 is provided on the side of the second surface 2*b* of the substrate 2 to face the first ground layer 21. The first ground layer 21 and the second ground layer 22 are each formed of a solid film continuously provided on the first surface 2*a* and the second surface 2*b* of the substrate 2. The second ground layer 22 is connected to the first ground layer 21 with a plurality of via conductors 26 interposed therebetween, the plurality of via conductors 26 connecting between the layers of the substrate 2. Each of the via conductors 26 is a conductor provided in a through hole extending between the layers of the substrate 2.

Although an illustration is omitted in FIG. 3, the first ground layer 21 and the second ground layer 22 are connected to each other at a plurality of portions. The first ground layer 21 is exposed at the first surface 2*a* of the substrate 2 but is not limited thereto. A dielectric layer of the substrate 2 may be provided to cover the first ground layer 21. A dielectric layer of the substrate 2 is provided to cover the second ground layer 22 but is not limited thereto. The second ground layer 22 may be exposed at the second surface 2*b* of the substrate 2.

The power feeding line 33 and the connection wire 34 are provided in an inner layer of the substrate 2. The power feeding line 33 and the connection wire 34 are disposed between the first ground layer 21 and the second ground layer 22 in the Z direction. A dielectric layer of the substrate 2 is provided between the first ground layer 21, and the power feeding line 33 and the connection wire 34, and a dielectric layer of the substrate 2 is provided between the second ground layer 22, and the power feeding line 33 and the connection wire 34. Consequently, the power feeding line 33 and the connection wire 34 are insulated from the first ground layer 21 and the second ground layer 22.

The pad 37 is provided in or on the first surface 2*a* of the substrate 2 in a region overlapping an opening 21*a* of the first ground layer 21. The pad 37 is connected to the connection wire 34 with a via conductor 38 interposed therebetween. The first antenna element 31 is connected on the pad 37 and electrically connected to the connection wire 34 and the power feeding line 33. Although the first antenna element 31 is illustrated in FIG. 3, the second antenna element 32 is also electrically connected to the connection wire 34 and the power feeding line 33 in the same configuration. The pair of monopole antennas 3 is a vertical antenna including the first antenna element 31 and the second antenna element 32 that extend in a direction perpendicular to the first ground layer 21.

With such a configuration, noise from an external RFIC and an electronic device on which the antenna device 1 is mounted is shielded by the first ground layer 21 and the second ground layer 22. Consequently, the antenna device 1 suppresses noise from the outside from being propagated to the power feeding line 33 and the connection wire 34 and can obtain favorable radiating characteristics.

The sectional view in FIG. 3 is merely a schematic illustration, and the substrate 2 may be provided with wiring layers, ground layers, and the like that differ from the first ground layer 21, the second ground layer 22, the power feeding line 33, and the connection wire 34.

As illustrated in FIG. 3, the resin layer 8 is provided on or over the first surface 2*a* to cover at least a side surface of each of the first antenna element 31, the second antenna element 32 (refer to FIG. 1), and the first reflector 4. The resin layer 8 protects the first antenna element 31, the second antenna element 32, and the first reflector 4. The upper end of each of the first antenna element 31, the second antenna element 32, and the first reflector 4 is exposed at an upper surface 8*a* of the resin layer 8. In other words, the height of the resin layer 8 is equal to a height H1 of each of the first antenna element 31 and the second antenna element 32.

The height H1 of each of the first antenna element 31 and the second antenna element 32 is a length between the first surface 2*a* of the substrate 2 and the upper end of each of the first antenna element 31 and the second antenna element 32 in the Z direction. The resin layer 8 may be provided to cover the upper ends of the first antenna element 31, the second antenna element 32, and the first reflector 4. The height of the first reflector 4 is the same as the height H1 of each of the first antenna element 31 and the second antenna element 32 but is not limited thereto. The height of the first reflector 4 may differ from the height H1 of each of the first antenna element 31 and the second antenna element 32.

The height H1 of each of the first antenna element 31 and the second antenna element 32 is about ¼ of an effective wave length λeff. The effective wave length λeff is an actual wave length in consideration of the dielectric constant of the substrate 2. When a free space wave length is referred to as λ0, and the dielectric constant of the substrate 2 is referred to as 6*r*, the effective wave length λeff satisfies the relationship of the following expression (1).

$$\lambda 0 > \lambda eff > \lambda 0/(\varepsilon r^{1/2}) \quad (1)$$

As illustrated in FIG. 2, a distance between the first antenna element 31 and the second antenna element 32 in the Y direction is referred to as a distance D1. The distance D1 is longer than the height H1. More specifically, the distance D1 is about ½ of the effective wave length λeff. Consequently, in the direction (the Y direction) in which the first antenna element 31 and the second antenna element 32 are adjacent to each other, the respective signals emitted from the first antenna element 31 and the second antenna element 32 have opposite phases. Consequently, among the signals emitted from the first antenna element 31 and the second antenna element 32, signals in the Y direction are suppressed from being emitted. Thus, in the X-Y plane, the antenna device 1 can improve directivity in the −X direction with respect to the first antenna element 31 and the second antenna element 32, compared with when only one of the first antenna element 31 and the second antenna element 32 is provided.

First Modification of First Embodiment

Figure 4:
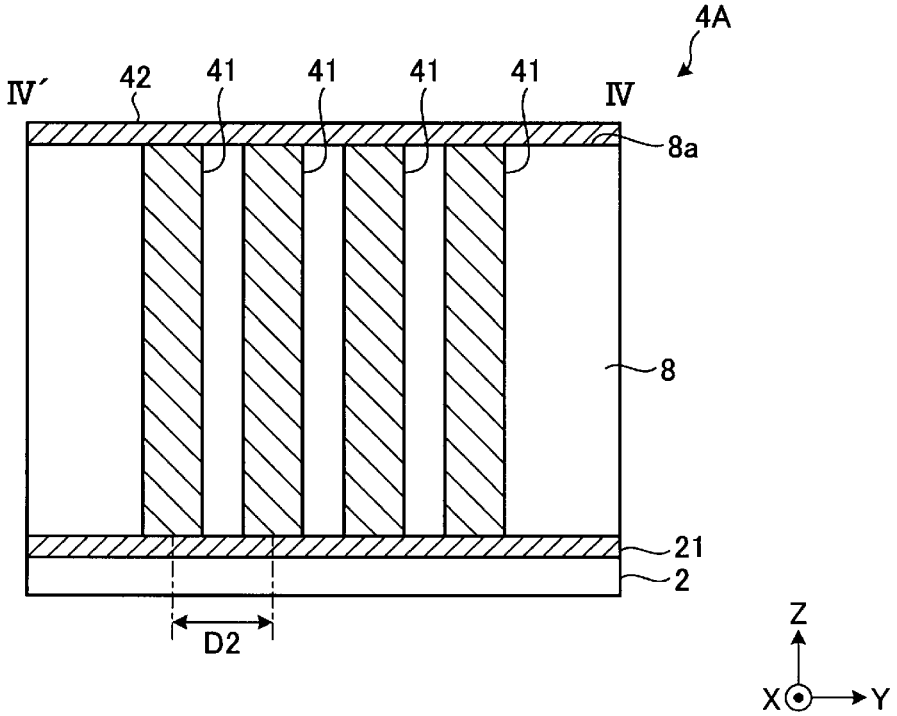
FIG. 4 is a sectional view of a first reflector according to a first modification of the first embodiment.

FIG. 4 is a sectional view of a first reflector according to a first modification of the first embodiment. FIG. 4 corresponds to a sectional view along line IV-IV' indicated in FIG. 2. In the first modification, a configuration in which a first reflector 4A includes a plurality of columnar conductors 41, differently from the aforementioned first embodiment, will be described. In the first reflector 4A, as illustrated in FIG. 4, the plurality of columnar conductors 41 each extend in the Z direction and are disposed side by side in the Y direction. The lower ends of the plurality of columnar conductors 41 are each connected to the first ground layer 21. The upper ends of the plurality of columnar conductors 41 are connected to each other by a coupling portion 42. As the plurality of columnar conductors 41, pins that are formed of a metal material are usable. The coupling portion 42 can be formed at the upper surface 8*a* of the resin layer 8 by printing.

A space is provided between the mutually adjacent columnar conductors 41. A distance D2 between the centers of the mutually adjacent columnar conductors 41 is about ⅙ of the effective wave length λeff. With such a configuration, the first reflector 4A electrically has the same effect as that when a plate-shaped or wall-shaped conductor is used.

In the present modification, as the columnar conductors 41 of the first reflector 4A, the same members as those of the first antenna element 31 and the second antenna element 32 are used. Therefore, the columnar conductors 41 can be provided in the substrate 2 in the same step as that for the first antenna element 31 and the second antenna element 32, and it is thus possible to suppress manufacturing costs of the antenna device 1.

Second Modification of First Embodiment

Figure 5:
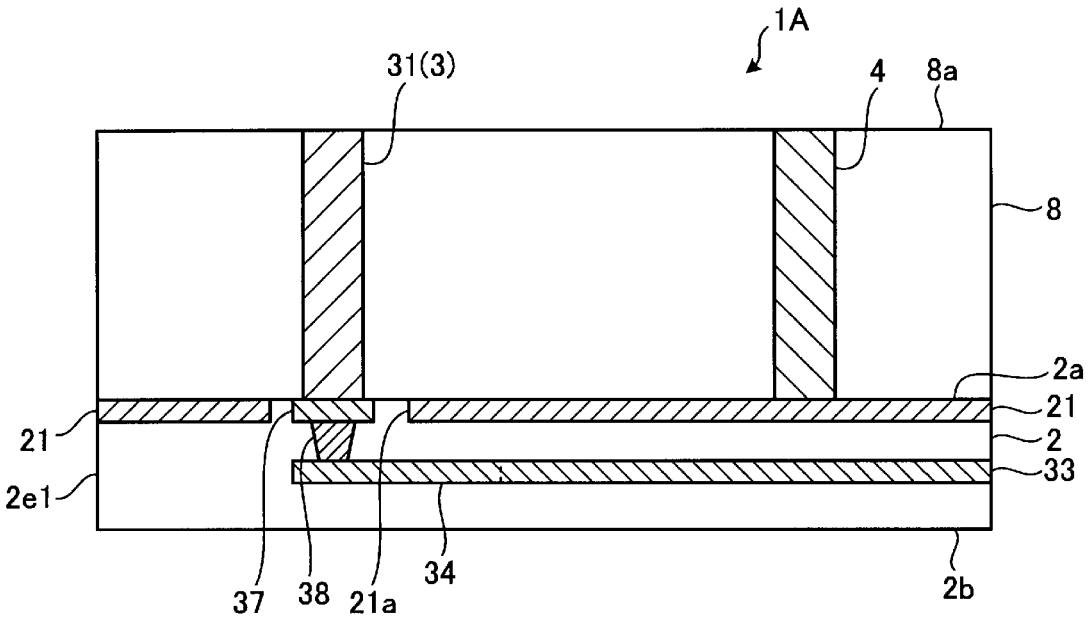
FIG. 5 is a sectional view of an antenna device according to a second modification of the first embodiment.

FIG. 5 is a sectional view of an antenna device according to a second modification of the first embodiment. FIG. 5 corresponds to a sectional view along line III-III' indicated in FIG. 2. In the second modification, a configuration in which the second ground layer 22 is not provided, differently from the first embodiment and the first modification mentioned above, will be described.

As illustrated in FIG. 5, the substrate 2 is provided with the first ground layer 21, and the second ground layer 22 is not provided on the side of the second surface 2*b*. In an antenna device 1A of the present modification, it is possible to simplify the layer configuration of the substrate 2, compared with the first embodiment. Also, in the present modification, the first ground layer 21 is provided as a ground layer with respect to the first antenna element 31 and the second antenna element 32, and the pair of monopole antennas 3 has the same directivity as that in the first embodiment.

The first antenna element 31, the second antenna element 32, and the columnar conductors 41 are not limited to pin-shaped conductors and can be each formed into a columnar shape by laminating metal layers by, for example, plating.

As described above, the antenna device 1 of the present embodiment includes the substrate 2, the first antenna element 31, the second antenna element 32, the first ground layer 21, the connection wire 34, the power feeding line 33, and the first reflector 4. The first antenna element 31 extends in the direction (the Z direction) perpendicular to the first surface 2*a* of the substrate 2 and functions as a monopole antenna. The second antenna element 32 is provided adjacent to the first antenna element 31, extends in the Z direction, and functions as a monopole antenna. The first ground layer 21 is provided in or on the substrate 2. The connection wire 34 is provided in or on the substrate 2 and connects the first antenna element 31 and the second antenna element 32 to each other. The power feeding line 33 is provided in or on the substrate 2 and connected to the connection wire 34. The first reflector 4 is provided in the direction (the Y direction) in which the first antenna element 31 and the second antenna element 32 are adjacent to each other, and faces the first antenna element 31 and the second antenna element 32. The substrate 2 has the first surface 2*a*, the second surface 2*b* facing the first surface 2*a*, the first end surface 2*e*1 and a second end surface 2*e*2 connecting the first surface 2*a* and the second surface 2*b* and facing each other, and a third end surface 2*e*3 and a fourth end surface 2*e*4 connecting the first surface 2*a* and the second surface 2*b* and present between the first end surface 2*e*1 and the second end surface 2*e*2 (refer to FIG. 10). The first antenna element 31 and the second antenna element 32 are provided along at least one end surface (the first end surface 2*e*1) of the first end surface 2*e*1 to the fourth end surface 2*e*4, overlap the first reflector 4 in a side view in a direction perpendicular to at least one end surface (the first end surface 2*e*1), and are located between at least one end surface (the first end surface 2*e*1) and the first reflector 4 in a plan view.

According to this, the first antenna element 31 and the second antenna element 32 are disposed adjacent to each other in the Y direction and connected to the common power feeding line 33. Thus, among the signals emitted from the first antenna element 31 and the second antenna element 32, signals in the Y direction are suppressed from being emitted. In addition, among the signals emitted from the first antenna element 31 and the second antenna element 32, signals in the +X direction are suppressed by the first reflector 4 from being emitted. Thus, in the plane (the X-Y plane) parallel to the first surface 2*a* of the substrate 2, the antenna device 1 can improve directivity in the −X direction with respect to the first antenna element 31 and the second antenna element 32, compared with when only one of the first antenna element 31 and the second antenna element 32 is provided.

In the antenna device 1 of the present embodiment, the distance (the distance D1) between the first antenna element 31 and the second antenna element 32 in a direction parallel to the first surface 2*a* of the substrate 2 is longer than the length (the height H1) of each of the first antenna element 31 and the second antenna element 32 in the direction perpendicular to the first surface 2*a* of the substrate 2.

According to this, for example, the height H1 is about ¼ of the effective wave length λeff, and the distance D1 can be about ½ of the effective wave length λeff. Consequently, in the direction (the Y direction) in which the first antenna element 31 and the second antenna element 32 are adjacent to each other, signals emitted from the first antenna element 31 and the second antenna element 32 have opposite phases. Consequently, among the signals emitted from the first antenna element 31 and the second antenna element 32, signals in the Y direction are suppressed from being emitted. The antenna device 1 can improve the gain of signals emitted in the −X direction with respect to the first antenna element 31 and the second antenna element 32.

Second Embodiment

Figure 6:
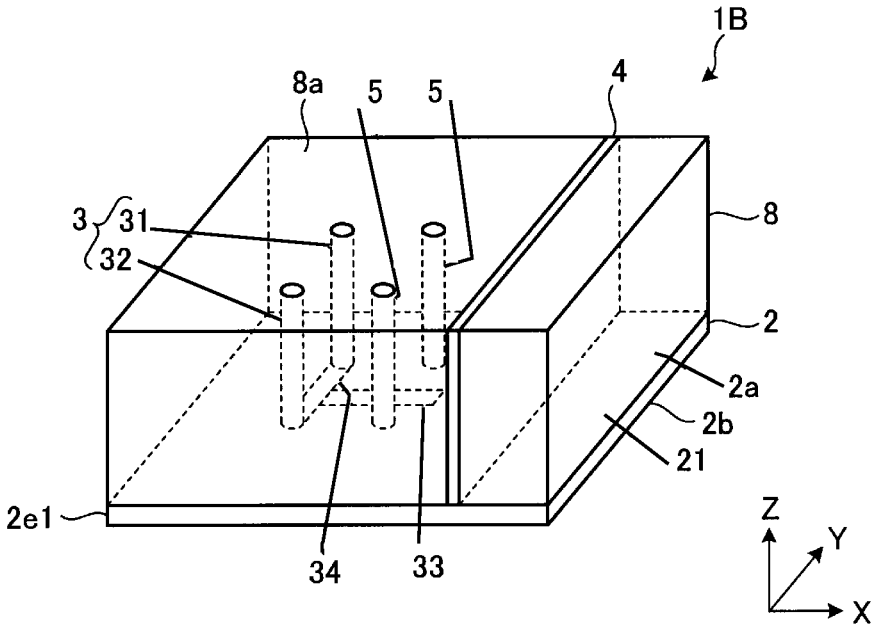
FIG. 6 is a transparent perspective view of an antenna device according to a second embodiment.
Figure 7:
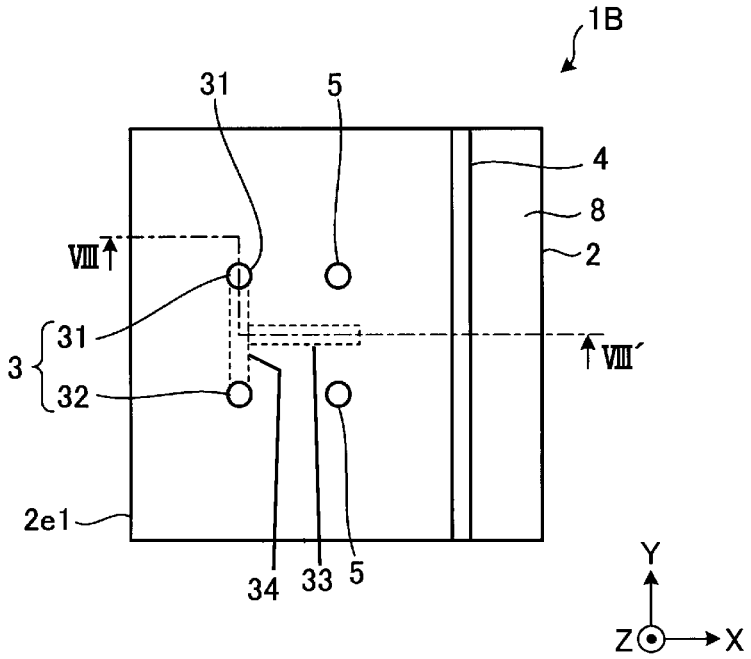
FIG. 7 is a plan view of the antenna device according to the second embodiment.
Figure 8:
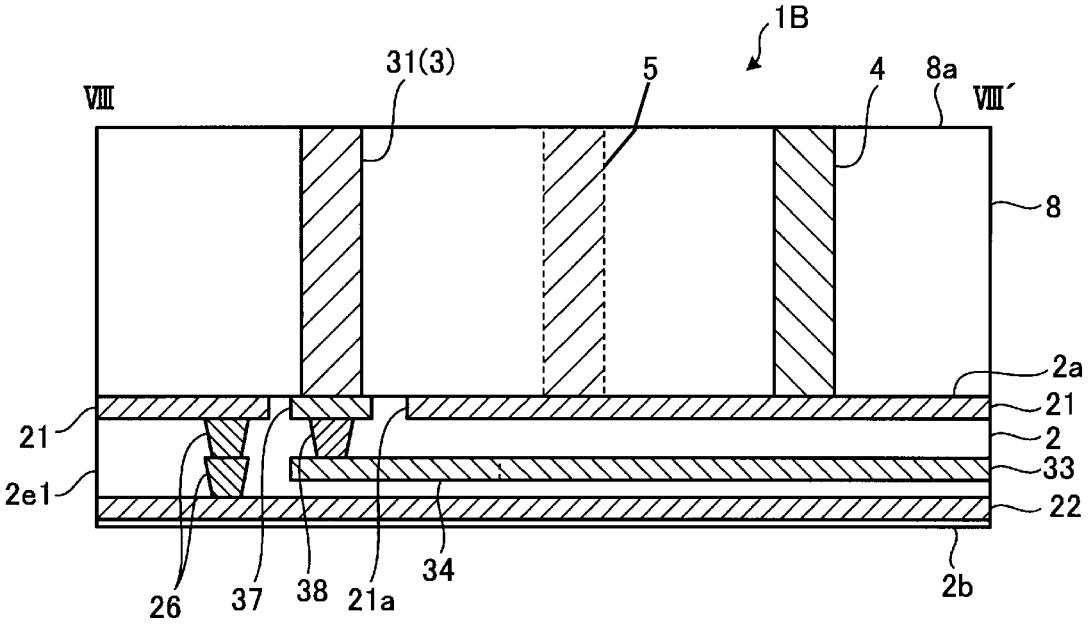
FIG. 8 is a sectional view along line VIII-VIII' of FIG. 7.

FIG. 6 is a transparent perspective view of an antenna device according to a second embodiment. FIG. 7 is a plan view of the antenna device according to the second embodiment. FIG. 8 is a sectional view along line VIII-VIII' of FIG. 7. In the second embodiment, a configuration in which second reflectors 5 are provided, differently from the aforementioned first embodiment, will be described.

As illustrated in FIG. 6 and FIG. 7, a plurality of the second reflectors 5 are each provided between the first reflector 4, and a corresponding one of the first antenna element 31 and the second antenna element 32. The plurality of second reflectors 5 extend in the direction perpendicular to the first surface 2*a* of the substrate 2. The first antenna element 31 is provided between one of the second reflectors 5 and the first end surface 2*e*1, and the second antenna element 32 is provided between the other of the second reflectors 5 and the first end surface 2*e*1. In other words, the plurality of second reflectors 5 extend in a direction parallel to the first antenna element 31 and the second antenna element 32 and are each adjacent to the first antenna element 31 and the second antenna element 32 corresponding thereto. The plurality of second reflectors 5 are disposed adjacent to each other in the Y direction with the power feeding line 33 interposed therebetween. The plurality of second reflectors 5 are columnar conductors and are, for example, pins that are formed of a metal material.

As illustrated in FIG. 8, the second reflectors 5 are provided on the first surface 2*a* of the substrate 2 and connected to the first ground layer 21. The resin layer 8 covers at least the side surfaces of the second reflectors 5, and the upper ends of the second reflectors 5 are exposed from the upper surface 8*a* of the resin layer 8.

Provided with the second reflectors 5, an antenna device 1B of the present embodiment can improve directivity in the −X direction also in a plane parallel to the X-Z plane with respect to the first antenna element 31 and the second antenna element 32. The X-Z plane is a plane perpendicular to the first surface 2*a* of the substrate 2 and is a plane orthogonal to the virtual line connecting the first antenna element 31 and the second antenna element 32.

Third Embodiment

Figure 9:
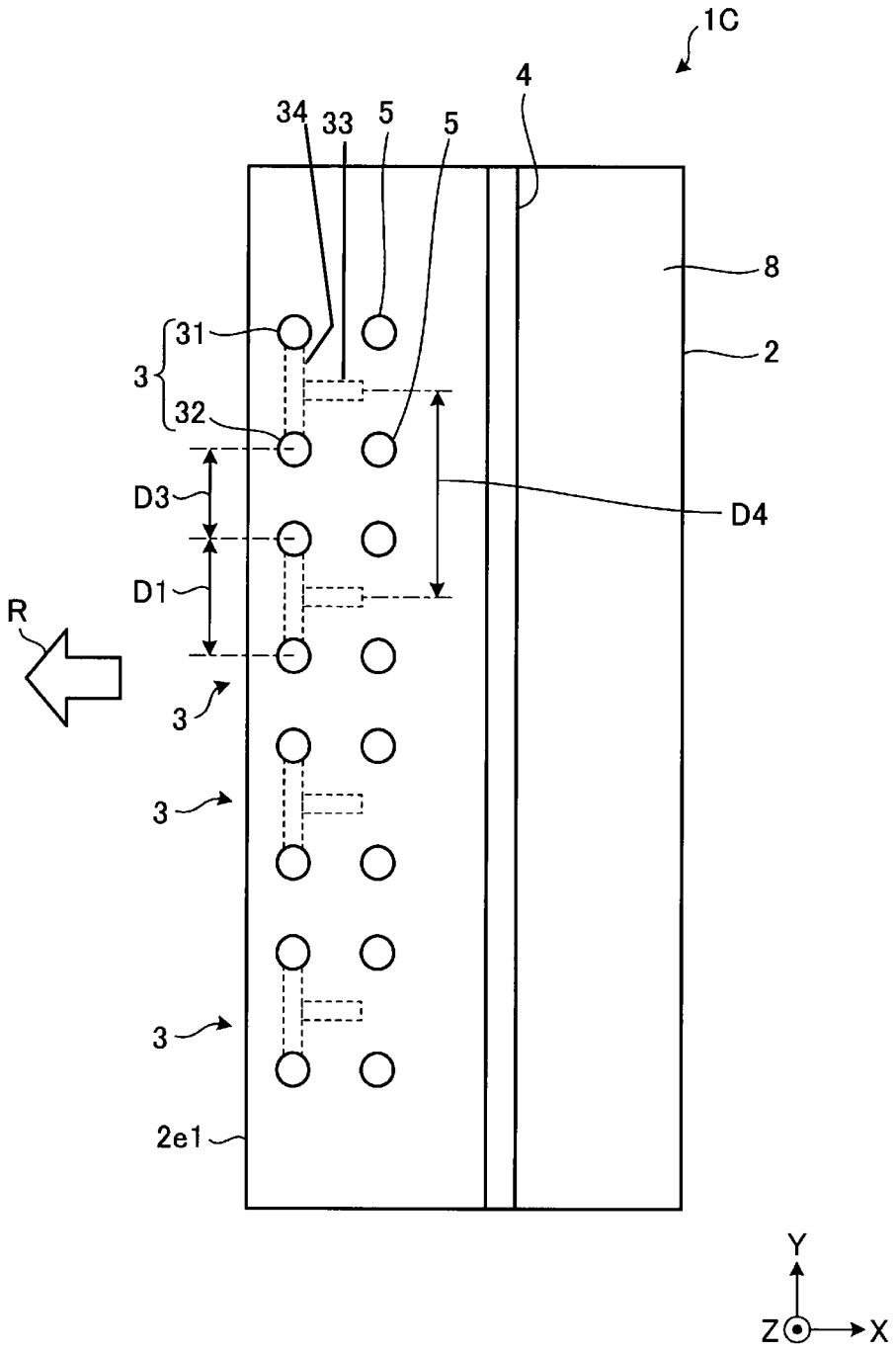
FIG. 9 is a plan view of an antenna device according to a third embodiment.

FIG. 9 is a plan view of an antenna device according to a third embodiment. In the third embodiment, a configuration in which a plurality of pairs of the monopole antennas 3 are provided, differently from the first embodiment and the second embodiment mentioned above, will be described.

As illustrated in FIG. 9, an antenna device 1C of the present embodiment is an array antenna, and, in the antenna device 1C, a plurality of pairs of the monopole antennas 3, each pair including the first antenna element 31 and the second antenna element 32, are arrayed. The plurality of pairs of monopole antennas 3 are arrayed along the first end surface 2*e*1 of the substrate 2. The first reflector 4 extends in an array direction (the Y direction) of the plurality of pairs of monopole antennas 3 and is provided to face the plurality of pairs of monopole antennas 3. Consequently, the first reflector 4 can improve directivity of each of the plurality of pairs of the monopole antennas 3 in the −X direction.

Each pair of monopole antennas 3 is the same as those in the first embodiment and the second embodiment, and the detailed description thereof is omitted. The first ground layer 21 (refer to FIG. 5 and FIG. 8) is formed continuously over the plurality of pairs of monopole antennas 3. Although the second reflectors 5 are provided in FIG. 9, a configuration in which the second reflectors 5 are not provided, as with the first embodiment, may be employed.

As illustrated in FIG. 9, the power feeding lines 33 are connected to the respective pairs of the monopole antennas 3. The antenna device 1C can emit signals with preferable directivity (radiating pattern) by causing the phases and the amplitude of signals supplied from the power feeding lines 33 to differ for each pair of the monopole antennas 3.

In two adjacent pairs of the monopole antennas 3, a distance between the first antenna element 31 and the second antenna element 32 that are not connected by the connection wire 34 is referred to as a distance D3. A distance in the Y direction between the power feeding lines 33 each connected to a corresponding one of two pairs of monopole antennas 3 is referred to as a distance D4. The distance D3 is smaller than the distance D4. The distance D3 is smaller than the distance D1. In other words, the distance D3 is less than or equal to ½ of the effective wave length λeff. The distance D4 is less than or equal to ½ of the free space wave length λ0. Consequently, the antenna device 1C can be downsized.

As described above, pairs of monopole antennas 3 each have directivity in the direction indicated by arrow R, that is, in the −X direction with respect to each of the pairs of monopole antennas 3, and radiation of signals in the Y direction is suppressed. Therefore, even when the distance D3 is reduced, interference between signals of the pairs of the monopole antennas 3 can be suppressed.

Although four pairs of monopole antennas 3 are illustrated in FIG. 9, the pairs of monopole antennas 3 are not limited thereto. The number of the pairs of the monopole antennas 3 may be two, three, or five or more. The configurations of the first modification and the second modification of the first embodiment illustrated in FIG. 4 and FIG. 5 are also applicable to the antenna device 1C of the present embodiment.

Fourth Embodiment

Figure 10:
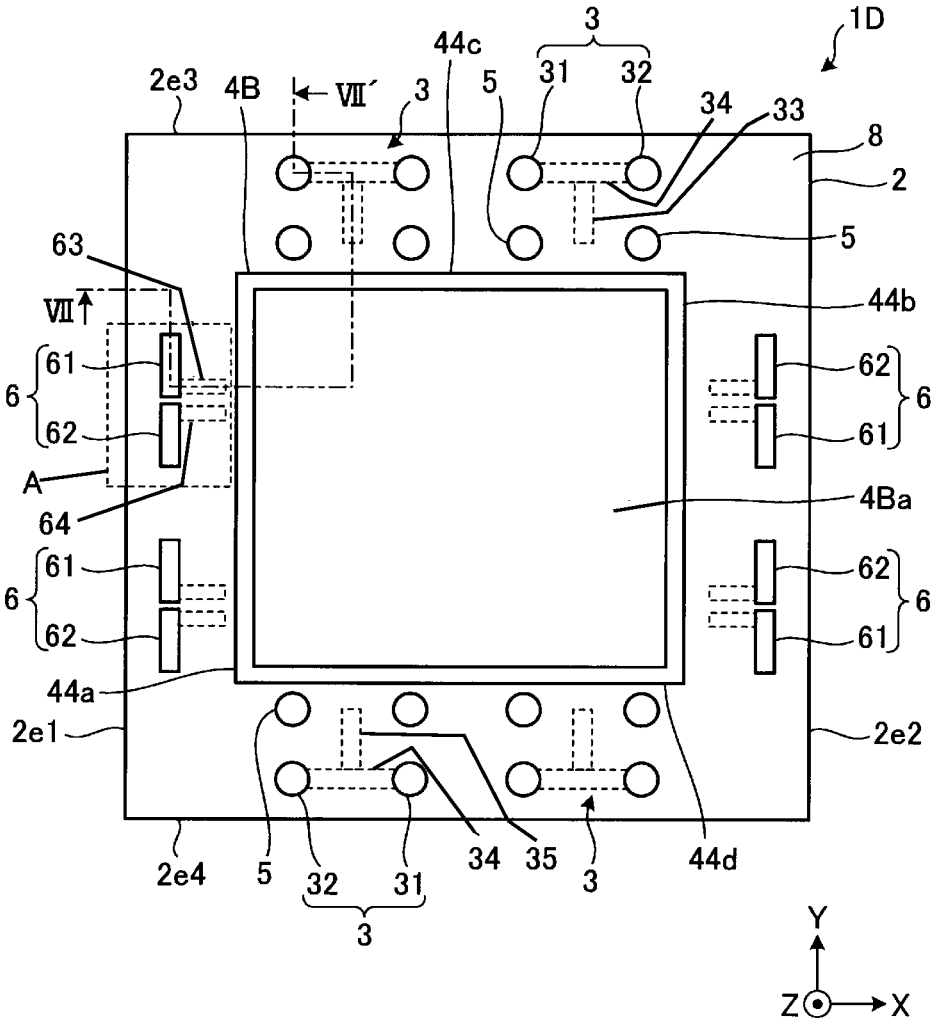
FIG. 10 is a plan view of an antenna device according to a fourth embodiment.
Figure 11:
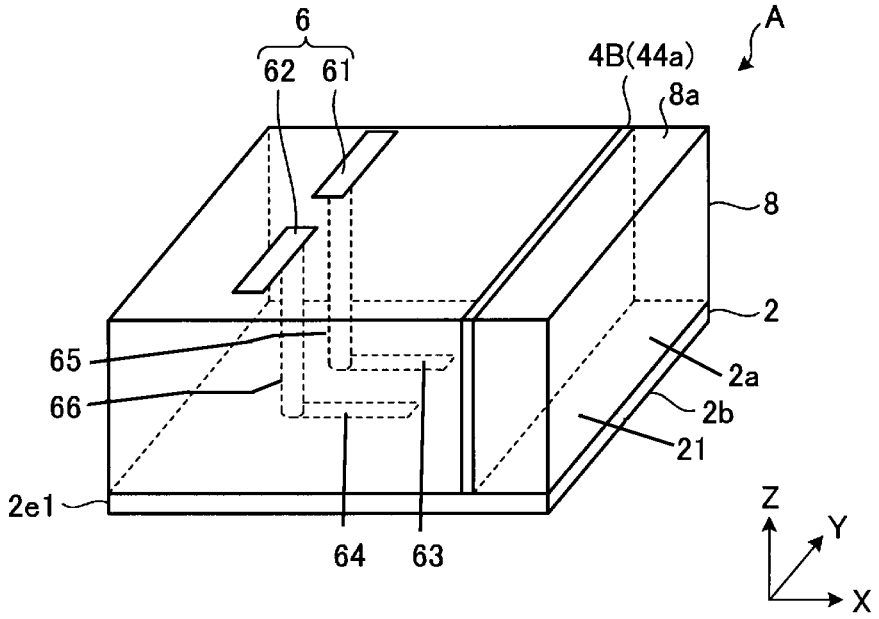
FIG. 11 is a transparent perspective view illustrating a region A of FIG. 10 in a partially enlarged manner.
Figure 12:
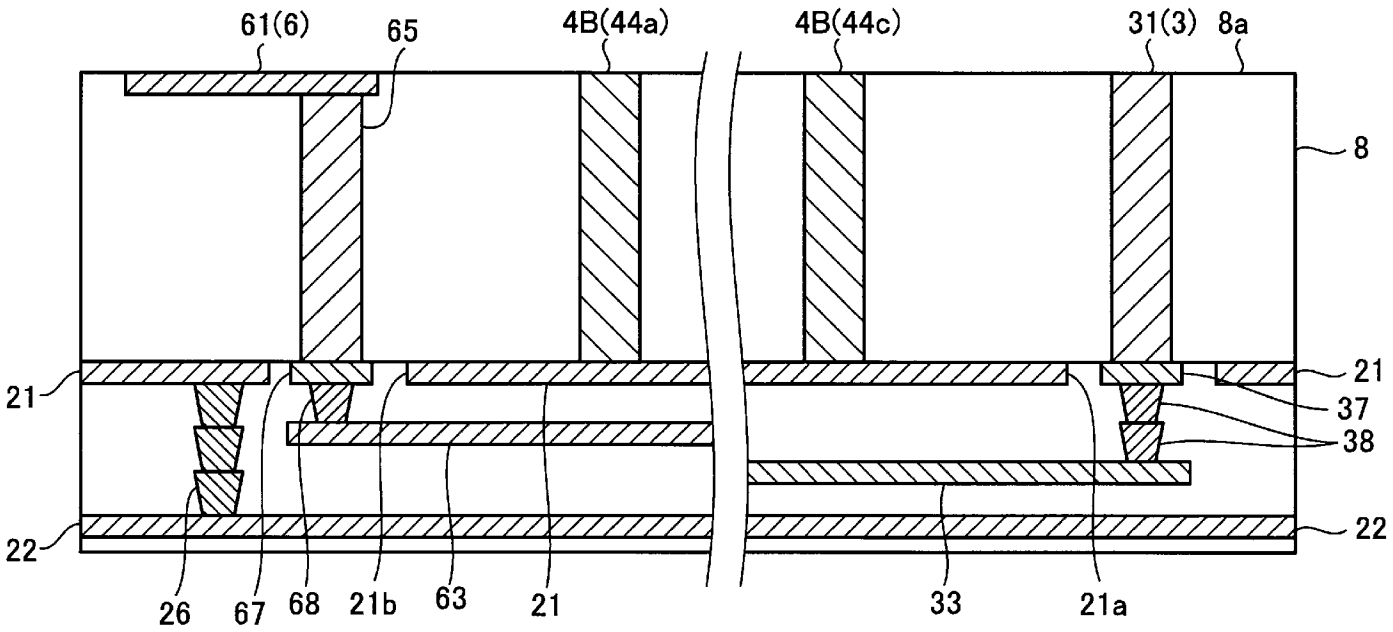
FIG. 12 is a sectional view along line XII-XII' of FIG. 10.

FIG. 10 is a plan view of an antenna device according to a fourth embodiment. FIG. 11 is a transparent perspective view illustrating a region A of FIG. 10 in a partially enlarged manner. FIG. 12 is a sectional view along line XII-XII' of FIG. 10. In the fourth embodiment, a configuration in which an antenna device 1D includes a plurality of pairs of the monopole antennas 3 and a plurality of dipole antennas 6, differently from the first embodiment and the third embodiment mentioned above, will be described.

As illustrated in FIG. 10, the substrate 2 in a plan view in the Z direction has a rectangular shape having the first end surface 2*e*1, the second end surface 2*e*2, the third end surface 2*e*3, and the fourth end surface 2*e*4. The first end surface 2*e*1 and the second end surface 2*e*2 face each other in the X direction. The third end surface 2*e*3 and the fourth end surface 2*e*4 are provided between the first end surface 2*e*1 and the second end surface 2*e*2. The third end surface 2*e*3 and the fourth end surface 2*e*4 face each other in the Y direction.

A plurality of the dipole antennas 6 are arrayed along each of the first end surface 2*e*1 and the second end surface 2*e*2. The plurality of pairs of monopole antennas 3 are arrayed along each of the third end surface 2*e*3 and the fourth end surface 2*e*4. Each pair of monopole antennas 3 is the same as those in the first embodiment and the second embodiment, and the detailed description thereof is omitted. Although each of the pairs of monopole antennas 3 is provided with the second reflectors 5 in FIG. 10, a configuration in which the second reflectors 5 are not provided, as with the first embodiment, may be employed.

The plurality of dipole antennas 6 each include a third antenna element 61 and a fourth antenna element 62. The third antenna element 61 extends in the direction (the Y direction) parallel to the first surface 2*a* of the substrate 2. The fourth antenna element 62 is disposed adjacent to the third antenna element 61 in the Y direction and extends in the Y direction. The third antenna element 61 and the fourth antenna element 62 are disposed side by side on one straight line and provided along each of the first end surface 2*e*1 and the second end surface 2*e*2.

The length of each of the third antenna element 61 and the fourth antenna element 62 in the Y direction is about ¼ of the effective wave length λeff. In other words, the total length of the third antenna element 61 and the fourth antenna element 62 is about ½ of the effective wave length λeff.

As illustrated in FIG. 11, the third antenna element 61 is connected to a first power feeding line 63 with a first connection conductor 65 interposed therebetween. The fourth antenna element 62 is connected to a second power feeding line 64 with a second connection conductor 66 interposed therebetween. The first power feeding line 63 and the second power feeding line 64 are provided in or on the substrate 2. The first connection conductor 65 and the second connection conductor 66 are columnar conductors and extend from the first surface 2*a* in the Z direction.

As illustrated in FIG. 10, a first reflector 4B is provided to face the plurality of pairs of monopole antennas 3 and the plurality of dipole antennas 6. Specifically, the first reflector 4B includes a first wall portion 44*a*, a second wall portion 44*b*, a third wall portion 44*c*, and a fourth wall portion 44*d*, and has a frame shape in a plan view. The first wall portion 44*a* and the second wall portion 44*b* are provided along the first end surface 2*e*1 and the second end surface 2*e*2, respectively.

The plurality of dipole antennas 6 are arrayed between the first wall portion 44*a* and the first end surface 2*e*1, and the plurality of dipole antennas 6 are arrayed between the second wall portion 44*b* and the second end surface 2*e*2. Similarly, the third wall portion 44*c* and the fourth wall portion 44*d* are provided along the third end surface 2*e*3 and the fourth end surface 2*e*4, respectively. The plurality of pairs of monopole antennas 3 are arrayed between the third wall portion 44*c* and the third end surface 2*e*3, and the plurality of pairs of monopole antennas 3 are arrayed between the fourth wall portion 44*d* and the fourth end surface 2*e*4.

The first reflector 4B has an opening 4Ba surrounded by the first wall portion 44*a*, the second wall portion 44*b*, the third wall portion 44*c*, and the fourth wall portion 44*d*. An IC, a circuit component, and the like can be mounted in a region of the substrate 2 overlapping the opening 4Ba.

Each of the first wall portion 44*a*, the second wall portion 44*b*, the third wall portion 44*c*, and the fourth wall portion 44*d* of the first reflector 4B may be a flat plate-shaped conductor or may have a configuration that can be considered to be electrically wall shape as a result of a plurality of columnar conductors being arrayed, as with in FIG. 4.

With such a configuration, each of the plurality of dipole antennas 6 can improve the directivity of signals emitted in a direction perpendicular to the first wall portion 44*a* and the second wall portion 44*b*, that is, in the −X direction and the +X direction. Each of the plurality of pairs of monopole antennas 3 can improve the directivity of signals emitted in a direction perpendicular to the third wall portion 44*c* and the fourth wall portion 44*d*, that is, in the −Y direction and the +Y direction.

Although the third antenna element 61, the first power feeding line 63, and the first connection conductor 65 are illustrated in FIG. 12, the description of the third antenna element 61, the first power feeding line 63, and the first connection conductor 65 is also applicable to the description of the fourth antenna element 62, the second power feeding line 64, and the second connection conductor 66.

As illustrated in FIG. 12, the first power feeding line 63 is provided in an inner layer of the substrate 2 and provided between the first ground layer 21 and the second ground layer 22 in the Z direction. A pad 67 is provided in a region overlapping an opening 21*b* of the first ground layer 21. The first power feeding line 63 is connected to the first connection conductor 65 with a via conductor 68 and the pad 67 interposed therebetween. The first power feeding line 63 is provided in a layer that differs from the layer where the power feeding lines 33 of the pairs of monopole antennas 3 are provided. The second power feeding line 64 is provided in the same layer as the layer where the first power feeding line 63 is provided.

The second ground layer 22 is provided below the pairs of monopole antennas 3 and below the dipole antennas 6. Therefore, noise from the outside is shielded by the first ground layer 21 and the second ground layer 22. Consequently, the antenna device 1D suppresses noise from the outside from being propagated to the first power feeding line 63 and the second power feeding line 64 and can obtain favorable radiating characteristics. Even when the antenna device 1D is incorporated in an electronic device including a housing and even when structures, for example, another substrate, a battery, a cable, a metallic heat dissipation member, and the like, in the housing are disposed below (for example, on the −Z side of FIG. 11) the antenna device 1D, the structures can be suppressed from functioning as a ground of the dipole antennas 6. In other words, it is possible to suppress the radiating characteristics of the dipole antennas 6 from changing due to the presence of the structures. This is because the influence of the structures on the radiating characteristics is small since the radiating characteristics of the antenna device 1D is designed by including the ground layers provided in or on the substrate 2 of the antenna device 1D.

Provided with the first ground layer 21 and the second ground layer 22, the dipole antennas 6 improve directivity also in an elevation angle direction. In other words, the dipole antennas 6 have directivity in a direction inclined to form a predetermined angle with the first surface 2*a* when viewed along the X-Z plane. Consequently, the antenna device 1D can widen a region in which signals can be emitted by the plurality of pairs of monopole antennas 3 and the plurality of dipole antennas 6.

As described above, in the antenna device 1D of the present embodiment, the plurality of pairs of monopole antennas 3 and the plurality of dipole antennas 6 are provided along the four sides of the substrate 2, and the first reflector 4B is provided to face the plurality of pairs of monopole antennas 3 and the plurality of dipole antennas 6. Consequently, the antenna device 1D can improve the directivity of signals emitted by each of the antennas in directions (the +X direction, the −X direction, the +Y direction, and the −Y direction) each orthogonal to the end surfaces of the substrate 2 while suppressing interference between the antennas.

Although two dipole antennas 6 are provided along each of the first end surface 2*e*1 and the second end surface 2*e*2 of the substrate 2, and two pairs of the monopole antennas 3 are provided along the third end surface 2*e*3 and the fourth end surface 2*e*4 in FIG. 12, the dipole antennas 6 and the pairs of monopole antennas 3 are not limited thereto. Three or more pairs of the dipole antennas 6 may be provided along each of the first end surface 2*e*1 and the second end surface 2*e*2, and three or more pairs of the monopole antennas 3 may be provided along each of the third end surface 2*e*3 and the fourth end surface 2*e*4. No antenna may be provided in a region along at least one end surface of the four end surfaces of the substrate 2. In other words, it is sufficient that at least one of the first end surface 2*e*1 and the second end surface 2*e*2 is provided with a plurality of the dipole antennas 6 and that at least one of the third end surface 2*e*3 and the fourth end surface 2*e*4 is provided with a plurality of pairs of the monopole antennas 3.

First Modification of Fourth Embodiment

Figure 13:
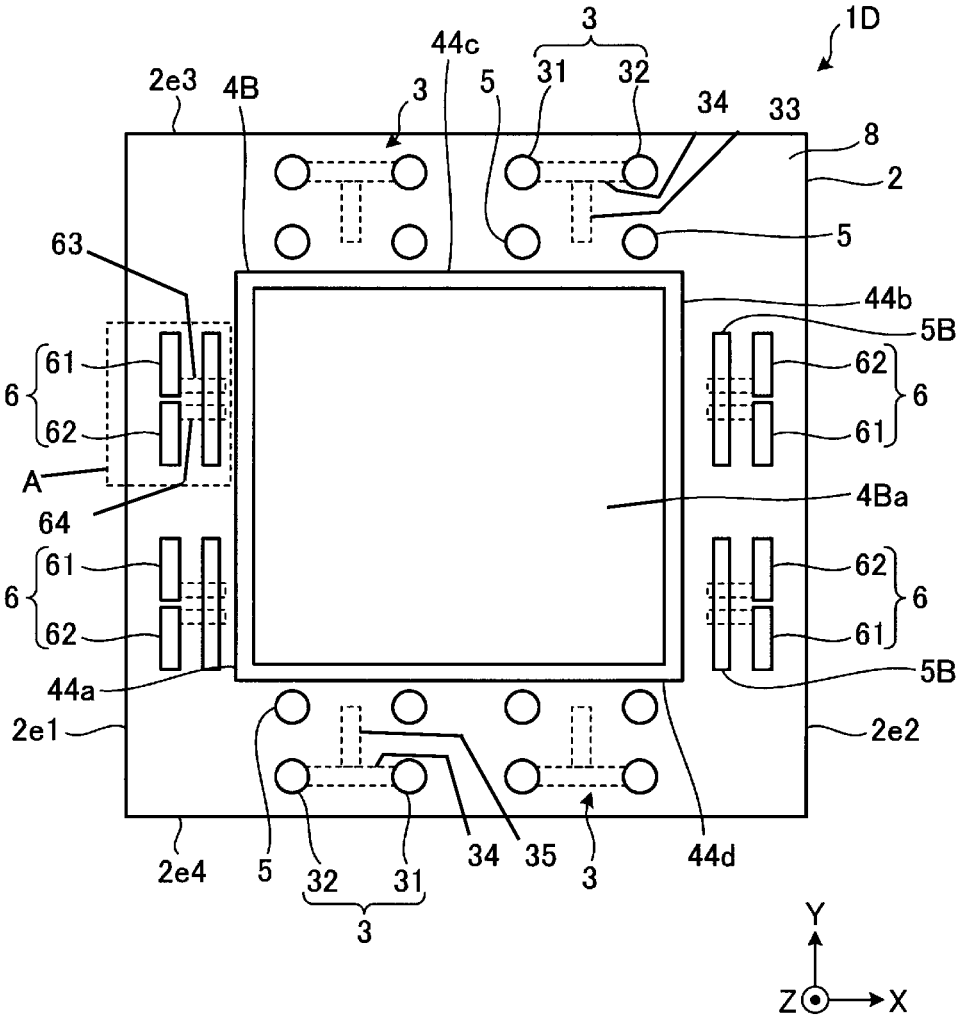
FIG. 13 is a plan view of an antenna device according to a first modification of the fourth embodiment.
Figure 14:
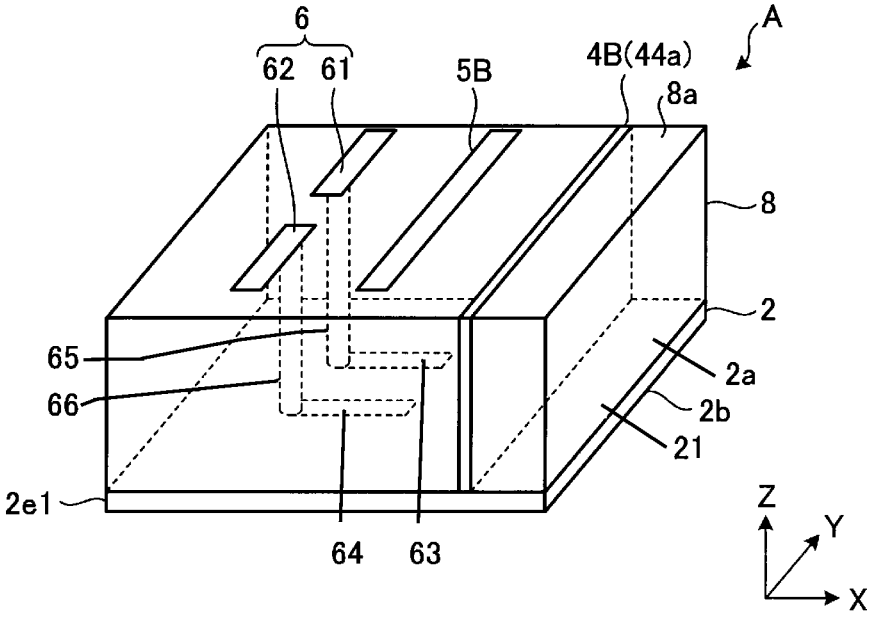
FIG. 14 is a transparent perspective view illustrating the region A of FIG. 13 in a partially enlarged manner.

FIG. 13 is a plan view of an antenna device according to a first modification of the fourth embodiment. FIG. 14 is a transparent perspective view illustrating the region A in FIG. 13 in a partially enlarged manner. In the first modification of the fourth embodiment, a configuration in which each of the plurality of dipole antennas 6 is provided with a third reflector 5B, differently from the aforementioned fourth embodiment, will be described.

As illustrated in FIG. 13 and FIG. 14, the third reflector 5B is provided between the first reflector 4B, and the third antenna element 61 and the fourth antenna element 62. The third reflector 5B is provided along the third antenna element 61 and the fourth antenna element 62. The length of the third reflector 5B in the Y direction is about ½ of the effective wave length λeff. The third reflector 5B is formed at the upper surface 8*a* of the resin layer 8 by, for example, printing.

The installation of the third reflector 5B enables each of the plurality of dipole antennas 6 to improve, compared with the fourth embodiment, the directivity of signals emitted in a direction perpendicular to the first wall portion 44*a* and the second wall portion 44*b*, that is, in the +X direction and the −X direction.

Second Modification of Fourth Embodiment

Figure 15:
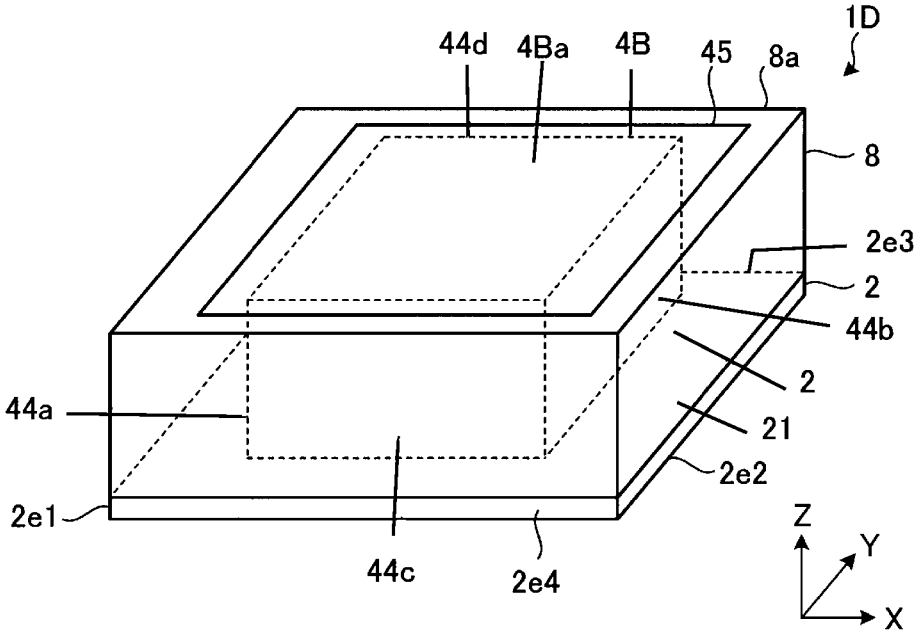
FIG. 15 is a transparent perspective view for describing a first reflector according to a second modification of the fourth embodiment.

FIG. 15 is a transparent perspective view for describing a first reflector according to a second modification of the fourth embodiment. In FIG. 15, the illustration of the pairs of monopole antennas 3 and the dipole antennas 6 is omitted for easy reference of the drawing. In the second modification of the fourth embodiment, a configuration in which a surface-layer conductor 45 is provided above the first reflector 4B, differently from the aforementioned fourth embodiment, will be described.

As illustrated in FIG. 15, the surface-layer conductor 45 is provided on the upper surface 8*a* of the resin layer 8 to cover the opening 4Ba of the first reflector 4B. The upper ends of the first wall portion 44*a*, the second wall portion 44*b*, the third wall portion 44*c*, and the fourth wall portion 44*d* are each connected to the surface-layer conductor 45. The lower ends of the first wall portion 44*a*, the second wall portion 44*b*, the third wall portion 44*c*, and the fourth wall portion 44*d* are connected to the first ground layer 21. The surface-layer conductor 45 includes portions that project in the plan view in the Z direction from the first wall portion 44*a*, the second wall portion 44*b*, the third wall portion 44*c*, and the fourth wall portion 44*d* in the +X direction, the −X direction, the +Y direction, and the −Y direction, respectively.

With such a configuration, in the second modification of the fourth embodiment, the directivity in each of the +X direction, the −X direction, the +Y direction, and the −Y direction can be improved in directions perpendicular to each of the first wall portion 44*a*, the second wall portion 44*b*, the third wall portion 44*c*, and the fourth wall portion 44*d*.

Fifth Embodiment

Figure 16:
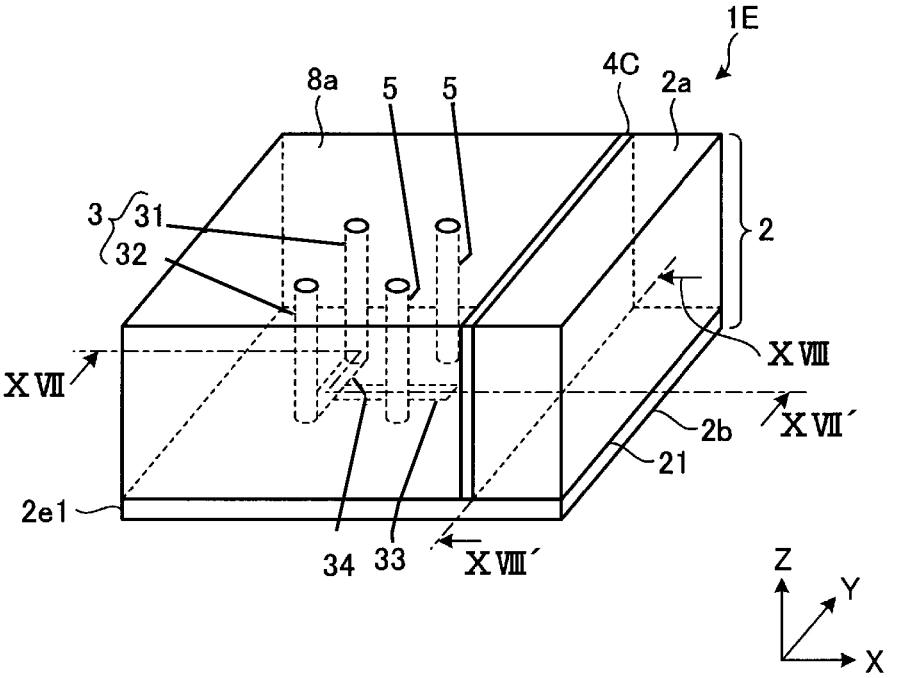
FIG. 16 is a transparent perspective view of an antenna device according to a fifth embodiment.
Figure 17:
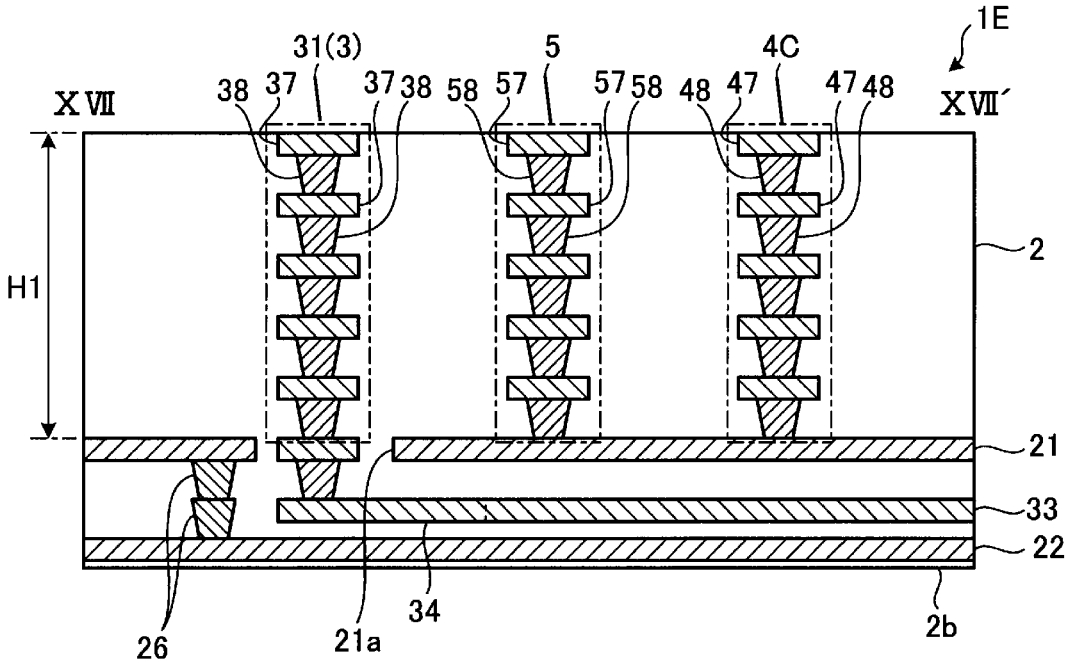
FIG. 17 is a sectional view along line XV-XV' of FIG. 16.
Figure 18:
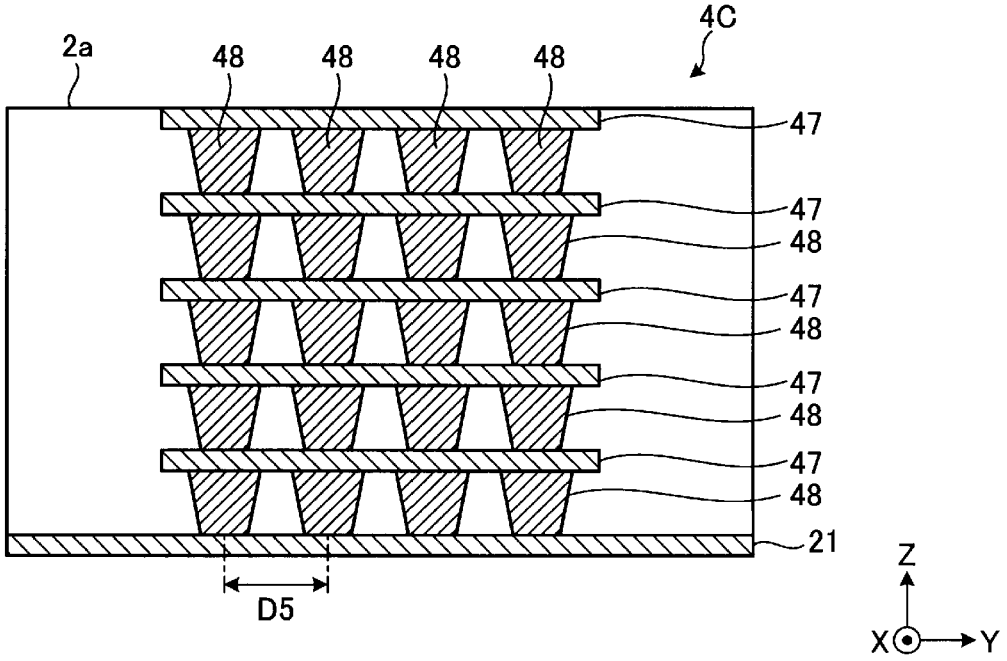
FIG. 18 is a sectional view along line XVI-XVI' of FIG. 16.

FIG. 16 is a transparent perspective view of an antenna device according to a fifth embodiment. FIG. 17 is a sectional view along line XV-XV' of FIG. 16. FIG. 18 is a sectional view along line XVI-XVI' of FIG. 16. In the fifth embodiment, a configuration in which members, such as the first antenna element 31, the second antenna element 32, a first reflector 4C, and the like, are provided in an inner portion of the substrate 2, differently from the first embodiment to the fourth embodiment mentioned above, will be described.

As illustrated in FIG. 16, the first antenna element 31, the second antenna element 32, the first reflector 4C, and the second reflectors 5 are provided between the first surface 2*a* and the second surface 2*b* of the substrate 2. The periphery of the first antenna element 31 is surrounded by the dielectric layer of the substrate 2. As illustrated in FIG. 17, the first antenna element 31 has a columnar shape as a whole as a result of a plurality of the via conductors 38 and a plurality of the pads 37 being continuous in the Z direction. The pad 37 at the uppermost portion of the first antenna element 31 is exposed at the first surface 2*a*. In the present embodiment, the height H1 of the first antenna element 31 is a length from the surface of the first ground layer 21 to the upper end of the first antenna element 31 in the Z direction.

The plurality of via 38 conductors and the plurality of pads 37 are disposed alternately; however, the plurality of via 38 conductors may be coupled to each other in the Z direction with some of the pads 37 omitted. Although the first antenna element 31 is illustrated in FIG. 16, the description regarding the first antenna element 31 is also applicable to the second antenna element 32.

Similarly, as illustrated in FIG. 17 and FIG. 18, a plurality of via conductors 48 and a plurality of connection conductors 47 are continuous in the Z direction also in the first reflector 4C. The plurality of via conductors 48 arrayed in the Z direction are arrayed in the Y direction. The plurality of via conductors 48 arrayed in the Y direction are connected by the plurality of connection conductors 47. A distance D5 between the centers of the via conductors 48 that are adjacent to each other in the Y direction is about ⅙ of the effective wave length λeff. Even with such a configuration, the first reflector 4C has the same effect as that when an electrically plate-shaped or wall-shaped conductor is used.

As illustrated in FIG. 17, each second reflector 5 also similarly has a columnar shape as a whole as a result of a plurality of via conductors 58 and a plurality of pads 57 being continuous in the Z direction.

In the present embodiment, the lengths (the diameters of the via conductors 38 and the diameters of the pads 37) of the first antenna element 31 in the direction parallel to the first surface 2*a* of the substrate 2 are periodically different in the direction (the Z direction) perpendicular to the first surface 2*a*. The current path of the current that flows through the first antenna element 31 is thus elongated, compared with when the diameter of the first antenna element 31 is constant in the Z direction. Therefore, in an antenna device 1E, the height H1 of the first antenna element 31 can be smaller than ¼ of the effective wave length λeff.

The configuration of the present embodiment is also applicable to the first embodiment to the fourth embodiment described above. For example, in the antenna device 1D of the fourth embodiment, the plurality of pairs of monopole antennas 3 and the plurality of dipole antennas 6 may be provided in the inner portion of the substrate 2. In this case, the third antenna element 61 and the fourth antenna element 62 (refer to FIG. 10 and FIG. 11) of each of the dipole antennas 6 are provided on the first surface 2*a* of the substrate 2. The first connection conductor 65 and the second connection conductor 66 (refer to FIG. 10 and FIG. 11) of each of the dipole antennas 6 are formed by a plurality of via conductors and a plurality of pads that are continuous in the Z direction.

Sixth Embodiment

Figure 19:
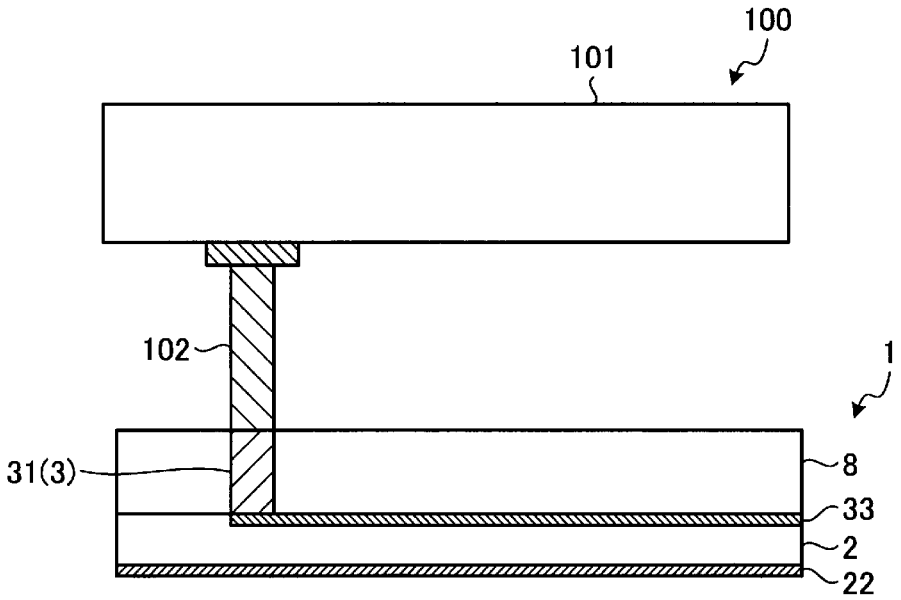
FIG. 19 is a sectional view schematically illustrating a configuration of an electronic device according to a sixth embodiment.

FIG. 19 is a sectional view schematically illustrating a configuration of an electronic device according to a sixth embodiment. Differently from the first embodiment to the fifth embodiment mentioned above, in the sixth embodiment, a configuration of an electronic device 100 including the antenna device 1 will be described.

As illustrated in FIG. 19, the electronic device 100 includes the antenna device 1, a housing 101, and a pin terminal 102. The first antenna element 31 (a pair of the monopole antennas 3) of the antenna device 1 is in contact with the pin terminal 102 mounted on the housing 101. The pin terminal 102 is a pogo pin and is a spring-type connector in which a spring is built in. Consequently, the tip of the pin terminal 102 and the first antenna element 31 are in contact with each other with a certain force. The length of the first antenna element 31 is substantially increased, compared with a case of only the antenna device 1, and the electronic device 100 thus can improve the gain.

First Modification of Sixth Embodiment

Figure 20:
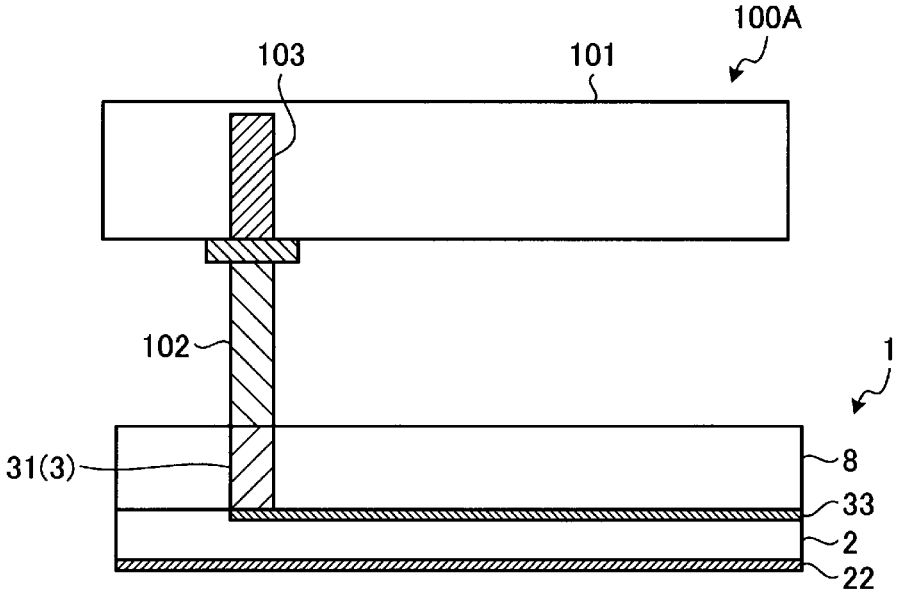
FIG. 20 is a sectional view of an electronic device according to a first modification of the sixth embodiment.

FIG. 20 is a sectional view of an electronic device according to a first modification of the sixth embodiment. Differently from the aforementioned sixth embodiment, in the first modification of the sixth modification, a configuration in which a conductor 103 is provided in an inner portion of the housing 101 of an electronic device 100A will be described.

As illustrated in FIG. 20, the conductor 103 extends from the lower surface of the housing 101 in the thickness direction of the housing 101. The lower end of the conductor 103 is connected to the pin terminal 102. Consequently, the length of the first antenna element 31 is substantially increased by the installation of the conductor 103, compared with the above-described sixth embodiment, and thus, the electronic device 100A can improve the gain.

Second Modification of Sixth Embodiment

Figure 21:
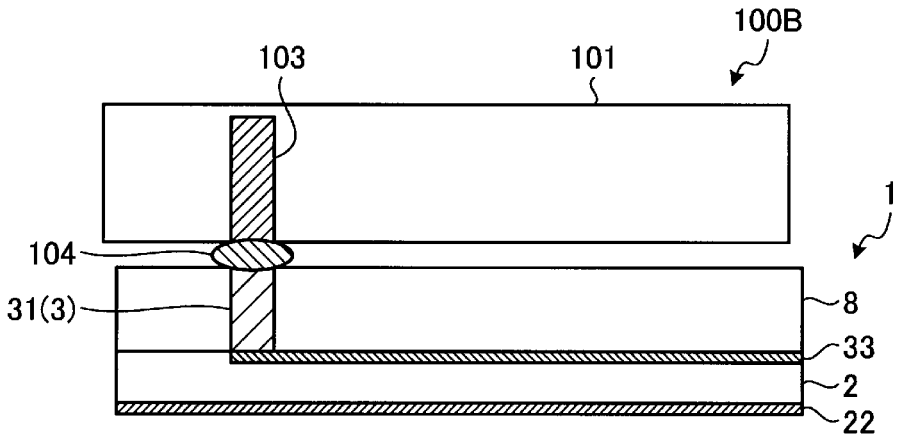
FIG. 21 is a sectional view of an electronic device according to a second modification of the sixth embodiment.

FIG. 21 is a sectional view of an electronic device according to a second modification of the sixth embodiment. Differently from the sixth embodiment and the first modification mentioned above, in the second modification of the sixth embodiment, a configuration in which the antenna device 1 is connected to the housing 101 of an electronic device 100B with solder 104 interposed therebetween will be described.

As illustrated in FIG. 21, the electronic device 100B is provided with the solder 104 as an alternative to the pin terminal 102 illustrated in FIG. 20. The first antenna element 31 is connected to the solder 104. The lower end of the conductor 103 is connected to the solder 104. In the second modification, the antenna device 1 is mounted to the housing 101 by a mounter device, and therefore, it is possible to improve positional accuracy due to a self-alignment effect at the time of solder mounting.

Third Modification of Sixth Embodiment

Figure 22:
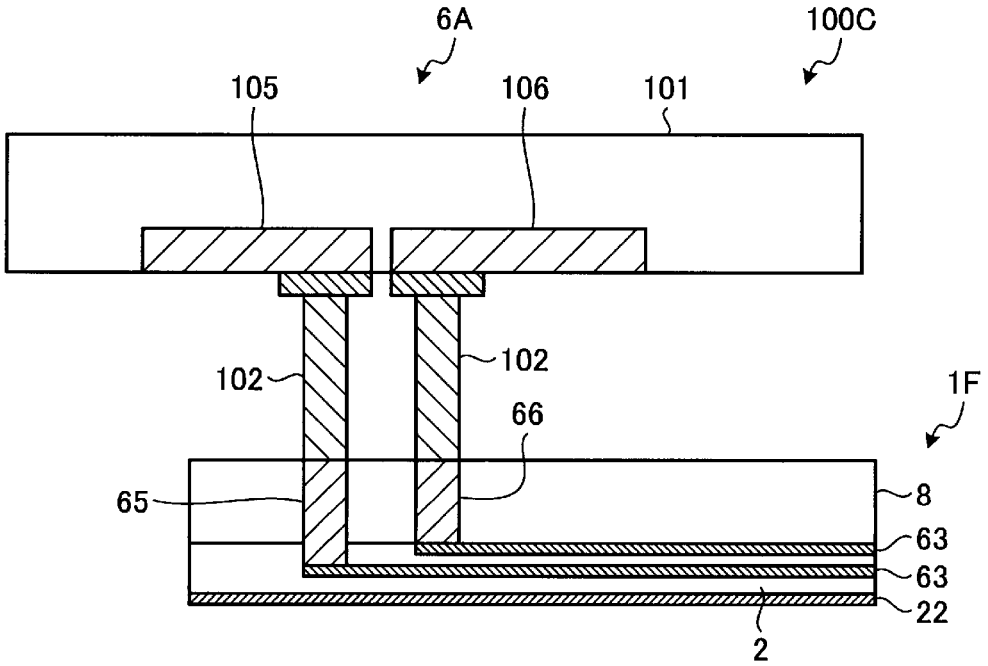
FIG. 22 is a sectional view of an electronic device according to a third modification of the sixth embodiment.

FIG. 22 is a sectional view of an electronic device according to a third modification of the sixth embodiment. Differently from the sixth embodiment, the first modification, and the second modification mentioned above, in the third modification of the sixth embodiment, a configuration in which the housing 101 of an electronic device 100C is provided with dipole antenna elements 105 and 106 will be described.

As illustrated in FIG. 22, the dipole antenna elements 105 and 106 are provided at the lower surface of the housing 101. The dipole antenna elements 105 and 106 are electrically connected to the first connection conductor 65 and the second connection conductor 66 of an antenna device 1F, respectively, with the respective pin terminals 102 interposed therebetween. Consequently, in the electronic device 100C, the first connection conductor 65, the second connection conductor 66, the pin terminal 102, and the dipole antenna elements 105 and 106 constitute a dipole antenna 6A. According to this, the dipole antenna elements 105 and 106 are each provided at a location away from the ground layer (the second ground layer 22), compared with a configuration in which the dipole antenna elements 105 and 106 are provided in the antenna device 1F. Thus, the electronic device 100C can improve the radiation efficiency and the band of the dipole antenna 6A.

1, 1A, 1B, 1C, 1D, 1E, 1F antenna device
2 substrate
2*a* first surface
2*b* second surface
2*e*1 first end surface
2*e*2 second end surface
2*e*3 third end surface
2*e*4 fourth end surface
3 pair of monopole antennas
4, 4A, 4B, 4C first reflector
4Ba opening
5 second reflector
5B third reflector
6 dipole antenna
8 resin layer
8*a* upper surface
21 first ground layer
21*a*, 21*b* opening
22 second ground layer
26, 38, 48, 58, 68 via conductor
31 first antenna element
32 second antenna element
33 power feeding line
34 connection wire
37, 57, 67 pad
41 columnar conductor
42 coupling portion
45 surface-layer conductor
47 connection conductor
61 third antenna element
62 fourth antenna element
63 first power feeding line
64 second power feeding line
65 first connection conductor
66 second connection conductor
100, 100A, 100B, 100C electronic device

The invention claimed is:

1. An antenna device comprising:

a substrate having a first surface, a second surface facing the first surface, a first end surface and a second end surface connecting the first surface and the second surface to each other and facing each other, and a third end surface and a fourth end surface connecting the first surface and the second surface to each other and present between the first end surface and the second end surface;

a first antenna element extending in a first direction perpendicular to the first surface of the substrate and functioning as a first monopole antenna;

a second antenna element provided adjacent to the first antenna element, extending in the direction perpendicular to the first surface of the substrate, and functioning as a second monopole antenna;

a ground layer provided in or on the substrate;

a connection wire provided in or on the substrate and connecting the first antenna element and the second antenna element to each other;

a power feeding line provided in or on the substrate and connected to the connection wire; and a first reflector provided in a second direction in which the first antenna element and the second antenna element are adjacent to each other and facing the first antenna element and the second antenna element, wherein the first antenna element and the second antenna element are provided along at least one end surface of the first end surface to the fourth end surface, overlap the first reflector in a side view in a direction perpendicular to the at least one end surface, and are located between the at least one end surface and the first reflector in a plan view.

2. The antenna device according to claim 1, wherein a distance between the first antenna element and the second antenna element in a direction parallel to the first surface of the substrate is longer than a length of each of the first antenna element and the second antenna element in the direction perpendicular to the first surface of the substrate.

3. The antenna device according to claim 1, further comprising:

a plurality of second reflectors each provided between the first reflector and a corresponding one of the first antenna element and the second antenna element, the plurality of second reflectors extending from the first surface of the substrate in the direction perpendicular to the first surface of the substrate.

4. The antenna device according to claim 1, wherein, in a direction parallel to the first surface of the substrate, a distance between a location at which the connection wire and the power feeding line are connected and the first antenna element is equal to a distance between the location at which the connection wire and the power feeding line are connected and the second antenna element.

5. The antenna device according to claim 1, wherein, in a direction parallel to the first surface of the substrate, a distance between a location at which the connection wire and the power feeding line are connected and the first antenna element differs from a distance between the location at which the connection wire and the power feeding line are connected and the second antenna element.

6. The antenna device according to claim 1, wherein a plurality of pairs of monopole antennas each including the first antenna element and the second antenna element are arrayed.

7. The antenna device according to claim 6, wherein, in two of the pairs of monopole antennas adjacent to each other, a distance between the first antenna element and the second antenna element not connected to each other by the connection wire is smaller than a distance between two of the power feeding lines connected to a corresponding one of the two of the pairs of monopole antennas.

8. The antenna device according to claim 6, wherein the first reflector is provided in a direction in which the plurality of pairs of monopole antennas are arrayed, the first reflector overlapping the plurality of pairs of monopole antennas in the side view and being located in a direction opposite to an end surface of the substrate.

9. The antenna device according to claim 6, further comprising:

at least one dipole antenna including a third antenna element extending in a direction parallel to the first surface of the substrate, and a fourth antenna element provided adjacent to the third antenna element and extending in the direction parallel to the first surface of the substrate.

10. The antenna device according to claim 9, wherein the at least one dipole antenna comprises a plurality of dipole antennas, wherein the plurality of dipole antennas are arrayed along at least one of the first end surface and the second end surface, and wherein the plurality of pairs of monopole antennas are arrayed along at least one of the third end surface and the fourth end surface.

11. The antenna device according to claim 10, wherein the first reflector is provided to face the plurality of pairs of monopole antennas and the plurality of dipole antennas.

12. The antenna device according to claim 1, wherein the first antenna element, the second antenna element, and the first reflector are provided on the first surface of the substrate, and wherein the antenna device further comprises a resin layer provided on or over the first surface to cover at least a side surface of each of the first antenna element, the second antenna element, and the first reflector.

13. The antenna device according to claim 1, wherein each of the first antenna element and the second antenna element is a columnar conductor.

14. The antenna device according to claim 1, wherein the first antenna element, the second antenna element, and the first reflector are provided between the first surface and the second surface.

15. The antenna device according to claim 14, wherein diameters of the first antenna element and the second antenna element are periodically different in the direction perpendicular to the first surface.

16. The antenna device according to claim 2, further comprising:

a plurality of second reflectors each provided between the first reflector and a corresponding one of the first antenna element and the second antenna element, the plurality of second reflectors extending from the first surface of the substrate in the direction perpendicular to the first surface of the substrate.

17. The antenna device according to claim 2, wherein, in a direction parallel to the first surface of the substrate, a distance between a location at which the connection wire and the power feeding line are connected and the first antenna element is equal to a distance between the location at which the connection wire and the power feeding line are connected and the second antenna element.

18. The antenna device according to claim 3, wherein, in a direction parallel to the first surface of the substrate, a distance between a location at which the connection wire and the power feeding line are connected and the first antenna element is equal to a distance between the location at which the connection wire and the power feeding line are connected and the second antenna element.

19. The antenna device according to claim 2, wherein, in a direction parallel to the first surface of the substrate, a distance between a location at which the connection wire and the power feeding line are connected and the first antenna element differs from a distance between the location at which the connection wire and the power feeding line are connected and the second antenna element.

20. The antenna device according to claim 3, wherein, in a direction parallel to the first surface of the substrate, a distance between a location at which the connection wire and the power feeding line are connected and the first antenna element differs from a distance between the location at which the connection wire and the power feeding line are connected and the second antenna element.

* * * * *